US006974103B1

(12) United States Patent
Pansini

(10) Patent No.: US 6,974,103 B1
(45) Date of Patent: Dec. 13, 2005

(54) HOSE REEL AUTOMATIC STORAGE

(76) Inventor: Andrew L. Pansini, 200 Golden Gate Ave., Belvedere, CA (US) 94920

( * ) Notice: Subject to any disclaimer, the term of this patent is extended or adjusted under 35 U.S.C. 154(b) by 0 days.

(21) Appl. No.: 10/078,802

(22) Filed: Feb. 19, 2002

(51) Int. Cl.[7] ..... B65H 75/44; B08B 3/00
(52) U.S. Cl. ..... 242/390.5; 134/167 R; 242/390.8
(58) Field of Search ..... 242/390.5, 390.2, 242/390.8; 134/167 R, 168 R; 4/490; 15/1.7; 137/355.2, 355.26; 266/7, 97.1

(56) References Cited

U.S. PATENT DOCUMENTS

| | | | | |
|---|---|---|---|---|
| 2,595,655 A | * | 5/1952 | Hannay | 242/390 |
| 3,139,099 A | | 6/1964 | Anthony | 134/167 |
| 3,217,738 A | * | 11/1965 | Springsteed | 137/355.2 |
| 3,278,949 A | * | 10/1966 | Whitaker | 210/169 |
| 3,289,216 A | | 12/1966 | Anthony | 4/172 |
| 3,392,738 A | | 7/1968 | Pansini | |
| 3,676,884 A | * | 7/1972 | Wulc | 15/1.7 |
| 4,228,553 A | | 10/1980 | Genuit | 4/490 |
| 4,281,995 A | | 8/1981 | Pansini | 440/38 |
| 4,348,192 A | | 9/1982 | Pansini | 440/38 |
| 4,768,532 A | | 9/1988 | Johnson | 134/111 |

FOREIGN PATENT DOCUMENTS

| | | | |
|---|---|---|---|
| JP | 11314841 A | * 11/1999 | B65H 49/34 |

* cited by examiner

*Primary Examiner*—Kathy Matecki
*Assistant Examiner*—Scott Haugland
(74) *Attorney, Agent, or Firm*—John K. Uilkema; Thelen Reid & Priest LLP

(57) ABSTRACT

A device for moving the hose of an automatic pool cleaner in and out of a swimming pool using water power. The device includes a rotatable hose reel in communication with a pool. The hose reel is connected to a rotatable water wheel having vertically-oriented blades disposed around its circumference. During storage, the hose of the pool cleaner is wrapped around the hose reel. To move the hose from the storage position into the pool, a stream of water from a blow out jet nozzle tangentially swipes the coiled hose and is directed at a cleaner head attached to the hose. The water flushes the cleaner head into the pool and rotates the hose reel in a first direction, causing the hose to unwind and travel into the pool. To move the hose from the pool back into the storage position, the cleaner is first turned off then pressurized water is directed horizontally at the vertically-oriented blades of the water wheel, causing the water wheel and hose reel to rotate in a second direction to withdraw the hose from the pool and rewind the hose onto the hose reel.

21 Claims, 7 Drawing Sheets

HOSE REEL AUTOMATIC STORAGE

BACKGROUND OF THE INVENTION

1. Field of the Invention

The present invention relates to an automatic storage device for use in connection with a swimming pool cleaner. More specifically, the invention relates to an automatic storage device for moving the hose of an automatic pool cleaner in and out of a swimming pool using water power. The device can be used with both conventional suction pool cleaners and conventional pressure pool cleaners.

2. Related Art

Both suction and pressure-type pool cleaners are well known in the art. U.S. Pat. No. 3,392,738 discloses a swimming pool cleaner including a length of hose attached at one end to a terminal cleaning nozzle and jet nozzle transport means for moving the hose along the bottom surface of a pool.

One problem associated with any type of pool cleaner is removal of the hose from the pool and storage of the hose when the cleaner is not in use. U.S. Pat. No. 3,392,738 discloses storage means including a cylindrical compartment containing a rotatable winding reel. The winding reel includes a drum portion attached to a base portion. Directing water through a first nozzle rotates the reel in a counter-clockwise direction to wind up the hose and directing water through a second nozzle rotates the reel in a clockwise direction to reel out the hose. The device of U.S. Pat. No. 3,392,738 would not effectively return to the pool, because it does not disclose a means for turning off the cleaner while the rotation jets are in operation. The cleaner would act to unwind the reel in opposition to the rotation jet. Also, the device cannot accommodate the head of a standard cleaner. A standard cleaner head includes an impeller; as water passes through the head, the impeller rotates, which turns a set of wheels that are in contact with the pool floor or walls. This allows the cleaner head to move about the pool. If such a cleaner head were pulled into the device, it would be lying on its side, with no wall or floor contact for the wheels, and would not be able to aid in unwinding the hose reel. Finally, the device does not lend itself for automation. A solenoid valve could not be placed on the revolving line to the rotation jet. Therefore, there is a need to provide a device for moving the hose of a pool cleaner in and out of a swimming pool, and particularly for returning the hose to the pool.

SUMMARY OF THE INVENTION

The present invention is directed to a device for moving the hose of an automatic pool cleaner in and out of a swimming pool. The device includes a tank in communication with the pool through a passageway and a rotatable hose reel having a drum portion and a circular base portion. Water jets connected to a pressurized water source direct water at the cleaner head of the hose to rotate the hose reel in a first direction and flush the hose into the pool. The device further includes a circular, rotatable water wheel connected to the hose reel. The water wheel has a plurality of vertically-oriented blades disposed around its circumference. Directing water horizontally at the blades of the water wheel causes the water wheel and hose reel to rotate in a second direction to remove the hose from the pool and rewind it around the hose reel.

According to an alternative embodiment, the water wheel is replaced with a set of rotation jets that rotate the hose reel. A donut-shaped, hollow swivel is utilized having a rotatable upper portion connected to the hose reel and a fixed lower portion connected to a pressurized water source. Supplying water to the interior chamber of the swivel causes the rotatable upper portion and the hose reel to rotate in a second direction to remove the hose from the pool and rewind it around the hose reel.

Other objects, features and advantages of the present invention will be apparent to those skilled in the art upon a reading of this specification including the accompanying drawings.

BRIEF DESCRIPTION OF THE DRAWINGS

The invention is better understood by reading the following Detailed Description of the Preferred Embodiments with reference to the accompanying drawing figures, in which like reference numerals refer to like elements throughout, and in which.

DETAILED DESCRIPTION OF THE PREFERRED EMBODIMENTS

Figure 1:
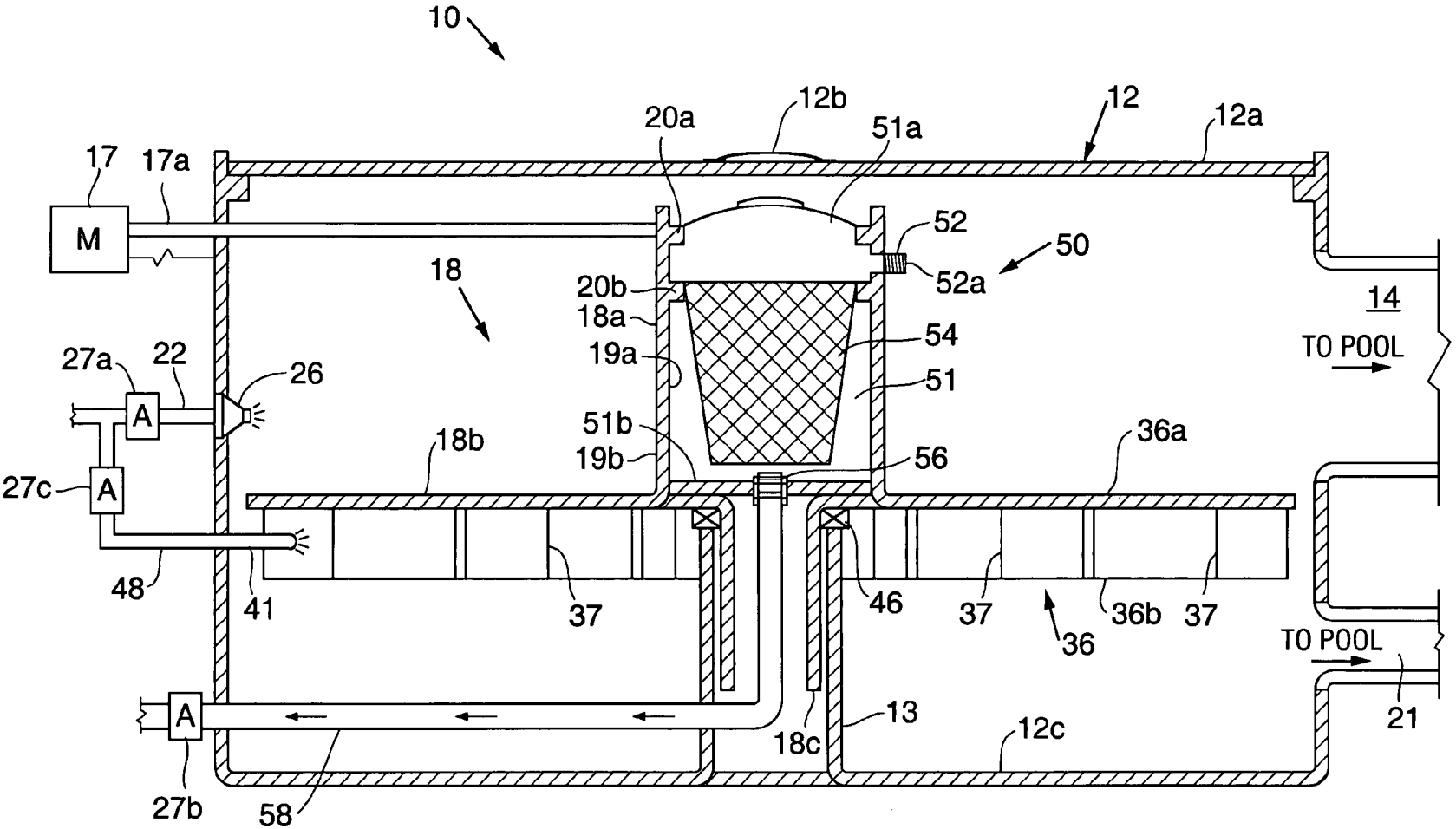
FIG. 1 is a cross-sectional elevational view of a first embodiment of the invention used in connection with a suction pool cleaner, showing the hose reel in cross-section, with the hose removed.

In describing preferred embodiments of the present invention illustrated in the drawings, specific terminology is employed for the sake of clarity. However, the invention is not intended to be limited to the specific terminology so selected, and it is to be understood that each specific element includes all technical equivalents that operate in a similar manner to accomplish a similar purpose.

The first and second embodiments of the hose reel automatic storage device, designated 110, 100, respectively, can be used in connection with either a conventional suction pool cleaner 50 or a conventional pressure pool cleaner 60.

Figure 2:
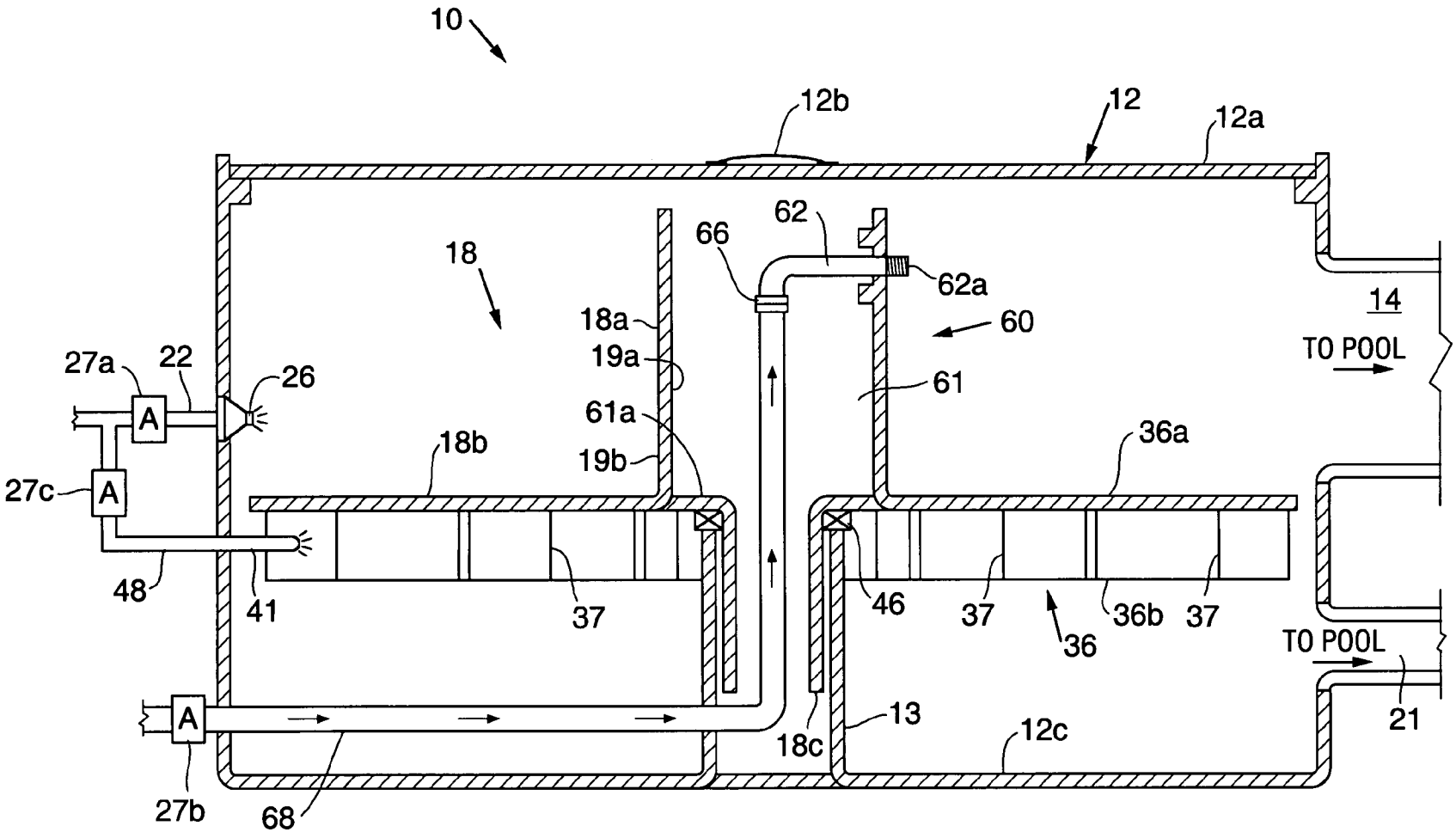
FIG. 2 is a cross-sectional elevational view of the first embodiment of the invention used in connection with a pressure pool cleaner, showing the hose reel in cross-section, with the hose removed.
Figure 3:
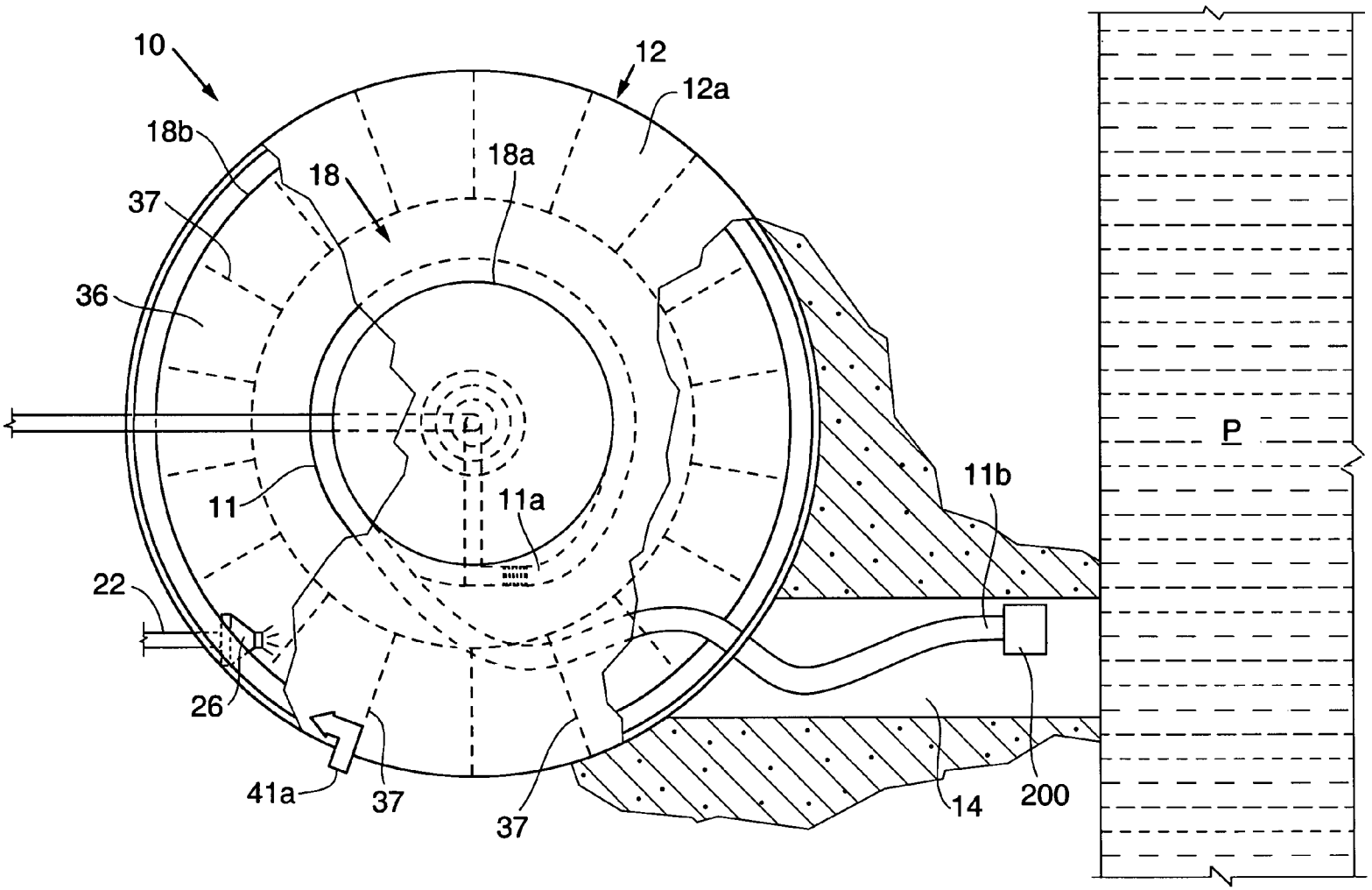
FIG. 3 is a top plan view of the first embodiment of the invention.

With reference to FIGS. 1–3, according to the first embodiment of the invention, device 10 includes a tank 12 having a removable cover plate 12*a* with a handle 12*b*; a hollow, rotatable hose reel 18 having an upper circular drum portion 18*a*, a circular base portion 18*b* adapted to support hose 11 when it is wound around drum portion 18*a* and a lower cylindrical portion 18*c* extending vertically downwardly from base portion 18*b*; and a circular, rotatable water wheel 36 connected to the base portion 18*b* and having a central hole formed therethrough. Tank 12 further includes a drain passageway 21 connecting the lower portion of tank 12, where water wheel 36 is located, to pool 16 and a support cylinder 13 concentric with the circular base portion 18*b*. A bearing 46 supports circular base portion 18*b* on the cylinder 13.

Tank 12 contains either suction cleaner 50 (FIG. 1) or pressure cleaner 60 (FIG. 2). Tank 12 is connected to swimming pool 14 through a horizontally extending passageway 14. Passageway 14 is configured to receive the hose 11 of suction pool cleaner 50 or pressure cleaner 60. Hose 11 is typically about 30 to 50 feet long and has a cleaner head 200 attached at one end. The cleaner head 200 of hose 11 may rest in passageway 14 during storage, when hose 11 is wound around hose reel 18. The cleaner head 200 can be any conventional cleaner head, such as that disclosed in U.S. Pat. No. 3,392,738 or the RAY-VAC® Automated Pool Vacuum sold by Waterpick Technologies—Jandy Products.

As illustrated in FIG. 1, suction pool cleaner 50 includes a leaf basket 54 contained in a sealed chamber 51 defined by the inner wall 19*a* of drum portion 18*a* of hose reel 18, cover plate 51*a* and floor 51*b* of chamber 51. Cover plate 51*a* is positioned over leaf basket 54 and held in place to seal off chamber 51 by circular shoulder 20*a*. Circular shoulder 20*b* engages the outer edge of basket 54. Hose connection 52 communicates with suction chamber 51 of suction pool cleaner 50 and terminates in cleaner fitting 52*a*, which is adapted to engage first end 11*a* of hose 11 (see FIG. 3). Pipe 58 is connected to a suction source (not shown) and extends vertically upwardly through lower cylindrical portion 18*c* of hose reel 18, the central hole in water wheel 36, floor 51*b* of chamber 51 and into chamber 51 via swivel 56. Pipe 58 and hose connection 52 preferably have diameters of about 1¼ to about 1½ inches.

As illustrated in FIG. 2, pressure pool cleaner 60 includes an open chamber 61 defined by the inner wall 19*a* of drum portion 18*a* of hose reel 18, and floor ledge 61*a* of chamber 61, which is formed integrally as a part of cylindrical portion 18*c* of hose reel 18. Pipe 68 is connected to a pressurized water source (not shown) and extends vertically upwardly through lower cylindrical portion 18*c* of hose reel 18, the central hole in water wheel 36, and into chamber 61, terminating at swivel 66. Elbow-shaped hose connection pipe 62 penetrates through an opening in hose reel 18, connects to pipe 68 via swivel 66 and is rotatable around the axis of swivel 66. Pipe 68 and hose connection pipe 62 preferably have diameters of about 1¼ to about 1½ inches. Hose connection pipe 62 terminates in cleaner fitting 62*a*, which is adapted to engage first end 11*a* of hose 11. Pressure pool cleaner 60 employs water pressure rather than suction. Therefore, it does not include a cover plate 51*a* or floor 51*b* as provided in suction pool cleaner 50, and hose reel 18 does not include circular shoulders 20*a*, 20*b*.

Tank 12 may be circular; preferably having a diameter of about 36 inches and a depth of about 12-to-16 inches. It is preferably constructed of stainless steel or plastic, but can be constructed of any other suitable material. Cover plate 12*a* is provided with handle 12*b* or any other suitable means, such as a central aperture, relative to the tank 12 to facilitate removal and replacement of cover plate 12*a* relative to the tank 12.

Rotatable hose reel 18 is preferably constructed of plastic but can be constructed of stainless steel, or any other suitable material. It preferably has a diameter of about 33 inches. Cylinder 13 of tank 12 extends vertically upwardly from floor 12*c* of tank 12 and terminates at circular bearing 46. Lower cylindrical portion 18*c* of hose reel 18 extends vertically downwardly through bearing 46 and cylinder 13 of tank 12 so that base portion 18*b* of hose reel 18 is mounted for rotation about a vertical axis on bearing 46.

As illustrated in FIGS. 2 and 3, hose 11 is connected at its first end 11*a* to suction cleaner fitting 52*a* or pressure cleaner fitting 62*a*. Second end 11*b* of hose 11 is connected to a conventional cleaner head 200. During storage, hose 11 is located in a first storage position, wound around outer surface 19*b* of drum portion 18*a* of hose reel 18 and resting on base portion 18*b* of hose reel 18. In this position, second end 11*b* of hose 11 and the cleaner head 200 rest in passageway 14.

Figure 7:
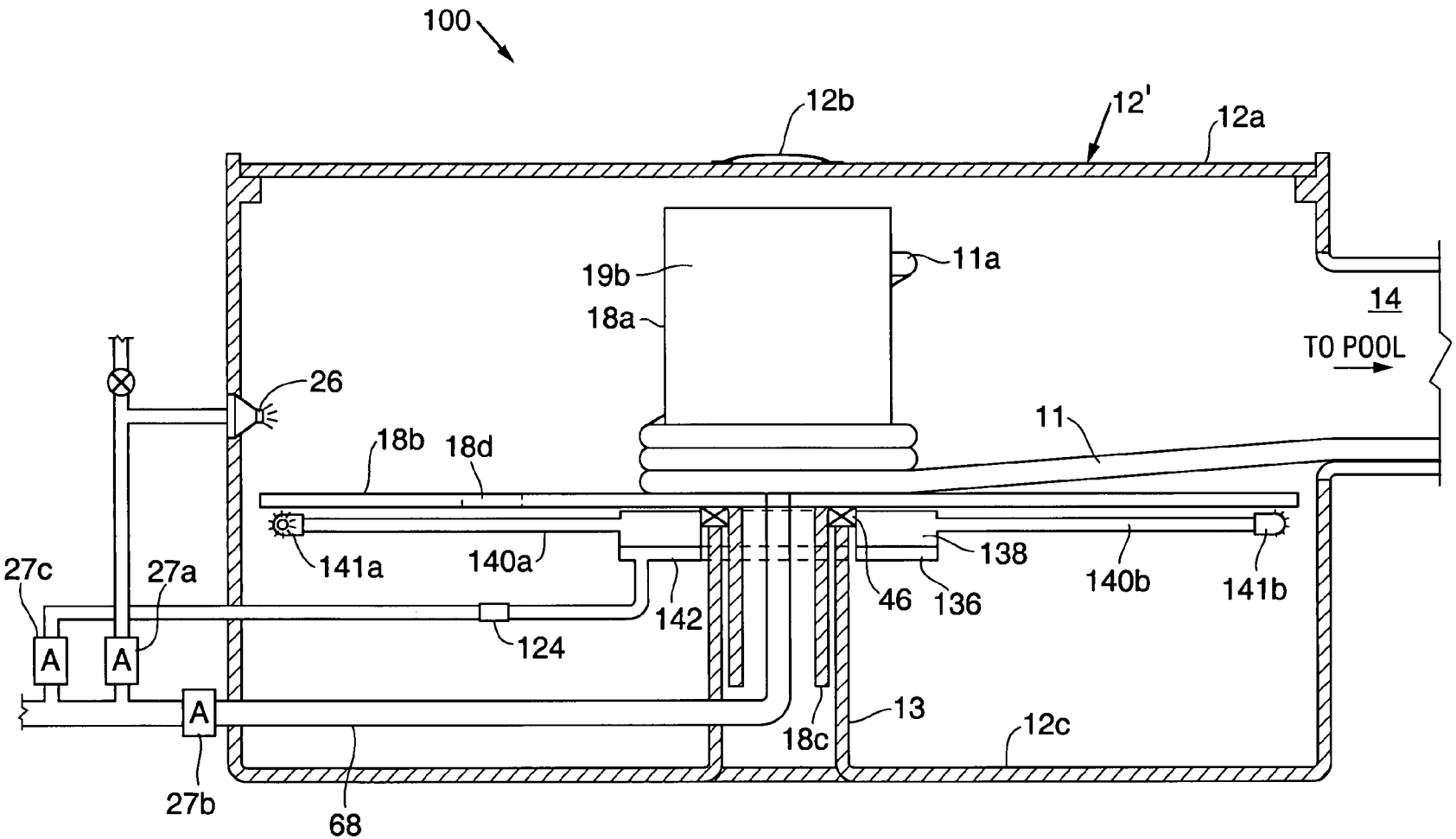
FIG. 7 is a cross-sectional elevational view of the second embodiment of the invention showing a hose wrapped around the hose reel.

When suction cleaner 50 or pressure cleaner 60 is in use, hose 11 is relocated to a second position in pool 16 (illustrated in FIG. 3 and in FIG. 7, with reference to the second embodiment), as follows. Pipe 22 is connected to a pressurized water source (not shown) at one end and a blow out jet nozzle 26 at the other end. Pipe 22 preferably has a diameter of about ¾ inch. Blow out jet nozzle 26 is comparable to a fire hose nozzle. To unwind hose 11 from hose reel 18 and move hose 11 from the first storage position to a second position in pool 16, the pressurized water source is turned on via solenoid valve 27*a* and water travels through pipe 22 and out blow out jet nozzle 26. The water is directed toward the cleaner head (not shown) of hose 11, and flushes cleaner head and hose 11 out of tank 12, through passageway 14 and into pool 16. This causes hose reel 18 to rotate in a first direction, and unwinds hose 11 from hose reel 18. This allows hose 11 to be moved from the first storage position (wound around hose reel 18) to a second position wherein hose 11 is unwound from hose reel 18 and travels through passageway 14 to pool 16, and second end 11*b* of hose 11 and the cleaner head (not shown) are located in pool 16.

According to the first embodiment of the invention, hose 11 is returned to the first storage position from the second position as follows. Circular water wheel 36 includes a plurality of vertically extending blades 37 disposed about its circumference between its upper surface 36*a* and its lower surface 36*b*. The water wheel 36 is configured to receive: (1) pipe 58 of suction cleaner 50 or pipe 68 of pressure cleaner 60, respectively, (2) cylinder 13 of tank 12 and (3) lower cylindrical portion 18*c* of hose reel 18. Hose reel 18 and water wheel 36 are preferably formed as a single unit by injection molding. Alternatively, if hose reel 18 and water wheel 36 are formed separately, upper surface 36*a* of water wheel 36 is connected to base portion 18*b* of hose reel 18 through any suitable connecting means, such as screws or other fasteners. Circular water wheel 36 is preferably constructed of plastic or any other suitable material.

Jet nozzle 41 is connected to pipe 48 which is connected to a pressurized water source (not shown). To rotate water wheel 36 and hose reel 18 in a second direction and rewind hose 11 onto hose reel 18, suction cleaner 50 (or pressure cleaner 60) is turned off via a conventional solenoid valve 27*b*. Then water is provided from the pressurized water source via conventional solenoid valve 27*c* through pipe 48 and jet nozzle 41 and directed horizontally at blades 37 of water wheel 36, causing rotation of water wheel 36 and hose reel 18 in a second direction. The general direction of water from jet nozzle 41 toward blades 37 of water wheel 36 is indicated by arrow 41*a* in FIG. 3. Such rotation withdraws hose 11 from pool 14 and rewinds hose 11 around outer surface 18*b* of hose reel 18 to return hose 11 to the first storage position wound around hose reel 18. Solenoid valves 27*a*, 27*b* and 27*c* may be any conventional valve, such as valves sold by Waterpick Technologies—Jandy Products.

The lower portion of tank 12 is in communication with pool 16 via passageway 21 so that water from pipe 48 flows into pool 16.

With reference to FIGS. 4–7, according to the second embodiment of the invention, device 100 includes tank 12' with removable cover plate 12*a* and a handle 12*b*; hose reel 18; and a hollow donut-shaped swivel 136 having a central hole formed therethrough and an inner chamber formed therein. Tank 12' does not include passageway 21 of tank 12.

Figure 4:
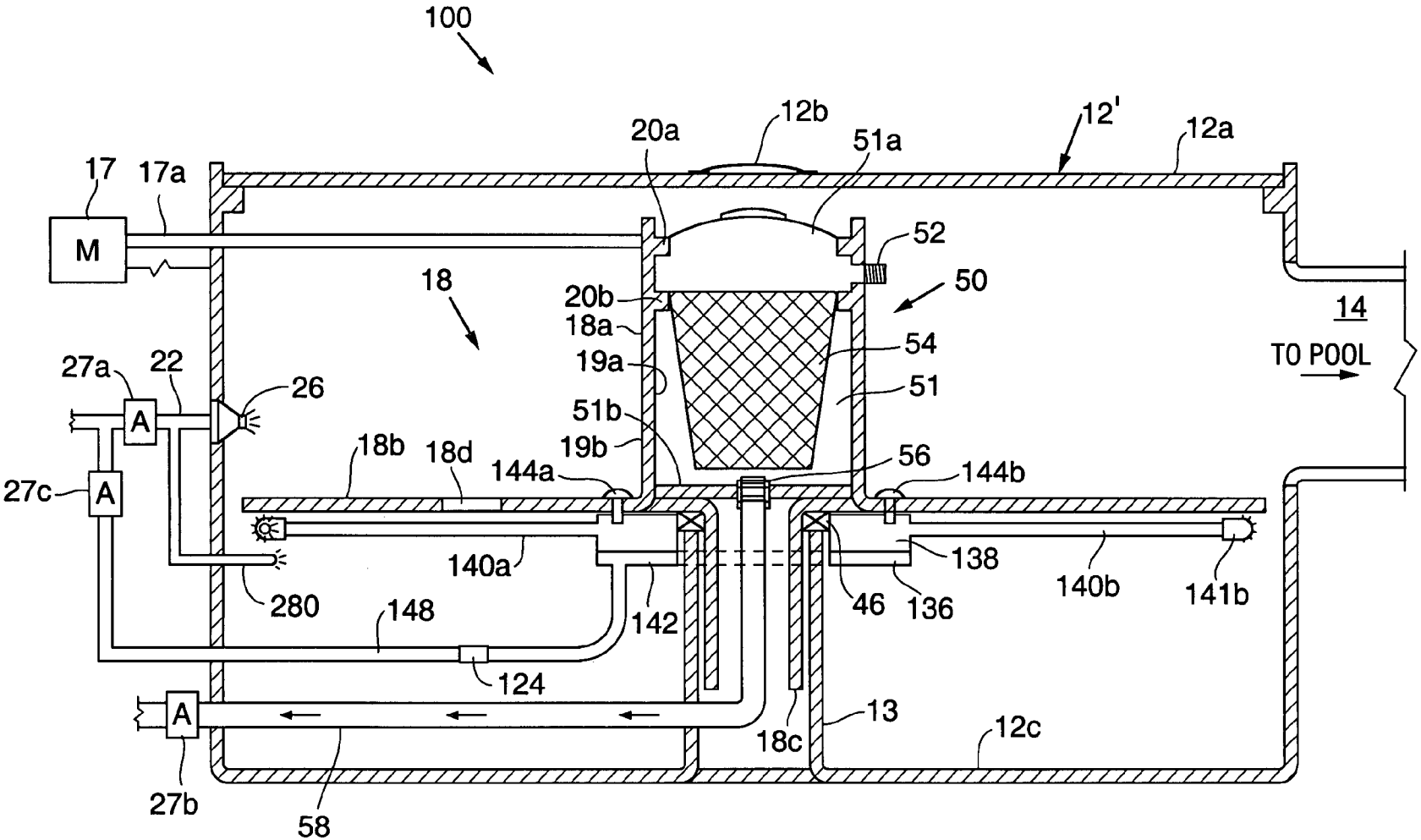
FIG. 4 is a cross-sectional elevational view of a second embodiment of the invention used in connection with a suction pool cleaner, showing the hose reel in cross-section, with the hose removed.
Figure 5:
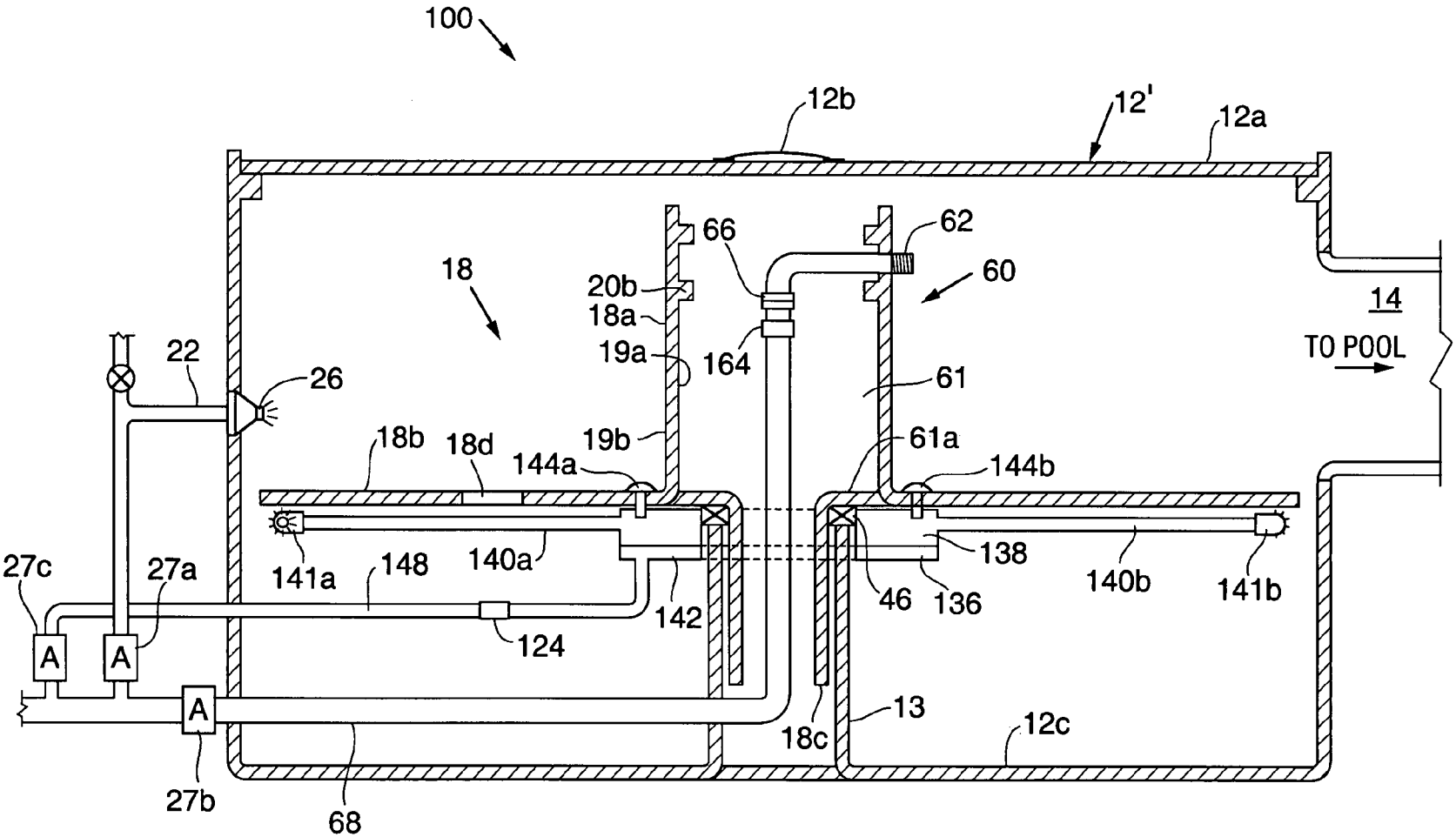
FIG. 5 is a cross-sectional elevational view of the second embodiment of the invention used in connection with a pressure pool cleaner, showing the hose reel in cross-section, with the hose removed.
Figure 6:
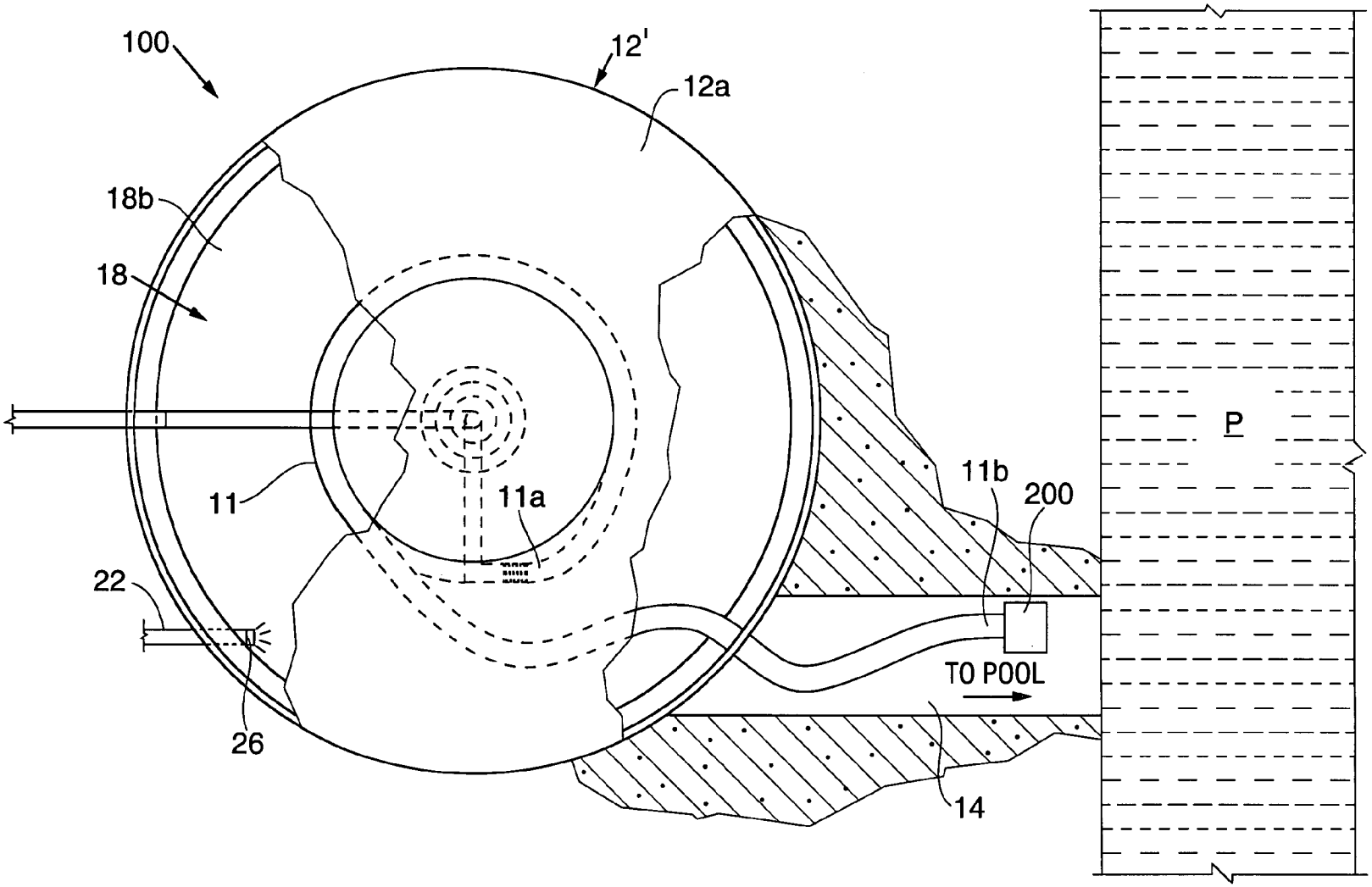
FIG. 6 is a top plan view of the second embodiment of the invention.

As illustrated in FIG. 4, a suction source (not shown) is connected to pipe 58. The pipe extends vertically upwardly through cylinder 13 of tank 12', cylindrical portion 18*c* of hose reel 18, the central hole in donut-shaped swivel 136, floor 51*b* of chamber 51 and into chamber 51 via swivel 56. Similarly, as illustrated in FIG. 5. The pipe 68 of pressure pool cleaner 60 is connected to a pressurized water source (not shown) and extends vertically upwardly through cylinder 13 of tank 12', cylindrical portion 18*c* of hose reel 18 and the central hole in donut-shaped swivel 136, and into chamber 61, terminating at swivel 66.

According to the second embodiment of the invention, hose 11 is returned to the first storage position from the second position as follows. Hollow, donut-shaped swivel 136 includes (1) a rotatable upper portion 138 having a first and second hollow rotation jet arms 140*a*, 140*b* extending horizontally outwardly therefrom and (2) a fixed lower portion 142. Rotatable upper portion 138 and fixed lower portion 142 are connected to each other, for example, by four or more clamps (not shown) attached to lower portions 142 that carry rollers which ride on a ledge (not shown) provided around the circumference of the upper portion 138. The central hole (not shown) formed in donut-shaped swivel 136 is configured to receive (1) pipe 58 of suction cleaner 50 or pipe 68 of pressure cleaner 60, respectively, (2) cylinder 13 of tank 12 and (3) cylindrical portion 18*c* of hose reel 18. Rotatable upper portion 138 of donut-shaped swivel 136 is connected to rotatable hose reel 18 via fasteners 144*a*, 144*b*, such as screws or any other suitable means. Donut-shaped swivel 136 is preferably constructed of plastic or any other suitable material.

Lower fixed portion 142 of donut-shaped swivel 136 is connected to pipe 148 which is connected to a pressurized water source (not shown). To rotate upper portion 138 of donut-shaped swivel 136 and hose reel 18 in a second direction and rewind hose 11 onto hose reel 18, suction cleaner 50 (or pressure cleaner 60) is turned off via solenoid valve 27*b*. Then water is provided from the pressurized water source via solenoid valve 27*c* through pipe 148 into the inner chamber (not shown) of donut-shaped swivel 136. The water travels through hollow first and second rotation jet arms 140*a*, 140*b* and out first and second water jets 141*a*, 141*b*, causing rotation of upper portion 138 of donut-shaped swivel 136 and hose reel 18 in a second direction. Such rotation withdraws hose 11 from pool 14 and rewinds hose 11 around outer surface 18*b* of hose reel 18 to return hose 11 to the first storage position wound around hose reel 18.

Although the preferred method for rotating hose reel 18 in a first direction to unwind hose 11 or a second direction to rewind hose 11, under both the first and second embodiments of the invention is water jet propulsion as described above, other means of rotation can be used either in addition to or instead of water jet propulsion. For example, a conventional electric motor 17 can be attached to hose reel 18. The motor 17 may include a drive belt 17*a* attached to hose reel 18. The motor 17 can be located in a well adjoining tank 12 with the drive belt operating in a horizontal plane just above the water level in tank 12.

According to a second example, one or more unwind jets 280 can be attached to pipe 22 to rotate upper portion 138 of donut-shaped swivel 136 and hose reel 18 in the second embodiment, in the first direction to aid the blow out jet in unwinding hose reel 18 and flushing the hose through the tunnel to the pool.

Device 10 is easily removed from tank 12 for maintenance as follows. Cover plate 12*a* of tank 12 or tank 12' is removed. According to the first embodiment, hose reel 18 can be simply lifted up and out of tank 12. According to the second embodiment, pipe 148 is disconnected at fastener 124 by utilizing access hole 18*d* (and, for pressure cleaner 60, pipe 68 is disconnected from hose connection pipe 62 at fastener 164), and hose reel 18 is simply lifted up and out of tank 12'. Access hole 18*d* is preferably about 6 to 8 inches in diameter.

Modifications and variations of the above-described embodiments of the present invention are possible, as appreciated by those skilled in the art in light of the above teachings. It is therefore to be understood that, within the scope of the appended claims and their equivalents, the invention may be practiced otherwise than as specifically described.

I claim:

1. A device for moving the hose of an automatic pool cleaner into a swimming pool, comprising:

a rotatable hose reel disposed within a tank in communication with the swimming pool through a tunnel, the hose being wound around the hose reel; and first jet means disposed in stationary relationship to the tank, said first jet means being directed towards the tunnel for propelling water toward the hose and through the tunnel to rotate the hose reel in a first direction and unwind and flush the hose through the tunnel into the pool.

2. The device of claim 1, wherein the first jet means comprises a water jet.

3. The device of claim 1, further comprising second jet means to assist in unwinding the hose and flushing the hose through the tunnel to the pool.

4. The device of claim 1, further comprising rotation means for rotating the hose reel in a second direction to withdraw the hose from the pool through the tunnel and rewind the hose around the hose reel.

5. The device of claim 4, wherein the rotation means comprises:

a circular, rotatable water wheel attached to the hose reel, the water wheel having a plurality of vertically-oriented blades disposed around its circumference; and jet means for directing water in a horizontal direction toward the blades of the water wheel to rotate the hose reel and water wheel in the second direction and withdraw the hose from the pool.

6. The device of claim 1, further comprising an electric motor for rotating the hose reel.

7. The device of claim 1, wherein the jet means comprises a fixed jet directed at the tunnel.

8. The device of claim 1, further comprising a second tunnel formed in the tank in communication with the swimming pool.

9. The device of claim 1, further comprising a solenoid valve connected to the first jet means for automatically operating the device.

10. A device for moving the hose of an automatic pool cleaner in and out of a swimming pool, comprising:

a rotatable hose reel disposed within a tank in communication with the swimming pool through a tunnel, wherein the hose is wound around the hose reel during storage, the hose having a cleaner head at one end;

a water jet disposed in stationary relationship to the tank for directing a stream of water at the cleaner head and the hose in the tunnel to rotate the hose reel in a first direction, unwind the hose from the hose reel and flush the cleaner head and hose through the tunnel to the pool, said water jet being fixed and directed at the tunnel; and rotation means for rotating the hose reel in a second direction to withdraw the hose from the pool through the tunnel and rewind the hose around the hose reel.

11. The device of claim 10, further comprising additional jet means for rotating the hose reel to assist in unwinding the hose and flushing the hose through the tunnel to the pool.

12. The device of claim 11, wherein the additional jet means comprises a water jet.

13. The device of claim 10, wherein the rotation means comprises:

a circular, rotatable water wheel attached to the hose reel, the water wheel having a plurality of vertically-oriented blades disposed around its circumference; and jet means for directing water in a horizontal direction toward the blades of the water reel to rotate the hose reel and water wheel in the second direction.

14. The device of claim 10, wherein the rotation means comprises an electric motor for rotating the hose reel.

15. A device for moving the hose of an automatic pool cleaner in and out of a swimming pool, comprising:

a tank in communication with the swimming pool through a tunnel;

a rotatable hose reel located in the tank, wherein the hose is wound around the hose reel during storage, the hose having a cleaner head at one end;

first jet means disposed in stationary relationship to the tank and directed toward the tunnel for directing a stream of water towards the tunnel and at the cleaner head to rotate the hose reel in a first direction, unwind the hose and flush the hose out of the tank through the tunnel and to the pool;

a rotatable, circular swivel attached to the hose reel; and second rotation means for rotating the swivel and the hose reel in a second direction to withdraw the hose from the pool through the tunnel and rewind the hose around the hose reel.

16. The device of claim 15, where the second rotation means comprises a motor for rotating the hose reel.

17. The device of claim 15, further comprising second jet means to assist in unwinding the hose and flushing the hose out of the tunnel into the pool.

18. The device of claim 15, wherein the rotatable, circular swivel has a lower fixed portion and an upper rotatable portion attached to the hose reel, a chamber is formed in the swivel, and at least one water jet is attached to the upper rotatable portion of the swivel and is in communication with the swivel chamber, wherein the second rotation means comprises:

a pressurized water source; and a pipe connecting the pressurized water source to the swivel chamber;

wherein water traveling from the pressurized water source through the swivel chamber and out water jet rotates the upper part of the swivel to rotate the swivel and hose reel in the second direction.

19. A method for moving the hose of an automatic pool cleaner in and out of a swimming pool, comprising:

providing a rotatable hose reel in a tank communicating with the pool through a tunnel having a first end in communication with the tank and a second end open to the pool, wherein the hose is wound around the hose reel and extends at least partially through the tunnel during storage, the hose having a cleaner head at one end; and directing at least one stream of water toward and into the first end of the tunnel, from a water jet disposed in stationary relationship to the tank and being directed toward the tunnel, to rotate the hose reel in a first direction and flush the hose through the second end of the tunnel and into the pool.

20. The method of claim 19, further comprising the step of rotating the hose reel in a second direction to withdraw the hose from the pool through the tunnel and rewind the hose around the hose reel.

21. A device for moving the hose of an automatic pool cleaner into a swimming pool, comprising:

a rotatable hose reel disposed within a tank, the hose being wound around the reel and extending therefrom through a tunnel having a first end in communication with the tank and a second end open to the pool; and water jet means disposed in stationary relationship to the tank and directed toward the tunnel to direct water into the first end of the tunnel to flush the hose through the tunnel and unwind the hose from the reel for discharge into the pool through the second end of the tunnel.

* * * * *